United States Patent [19]

Moran et al.

[11] Patent Number: 4,530,497

[45] Date of Patent: Jul. 23, 1985

[54] EXERCISING DEVICE

[76] Inventors: William Moran; Donald E. Bellerive, both of 8940 A, SW. 20 Pl., Fort Lauderdale, Fla. 33324

[21] Appl. No.: 487,271

[22] Filed: Apr. 21, 1983

[51] Int. Cl.[3] ..... A63B 31/00

[52] U.S. Cl. ..... 272/71; 434/254

[58] Field of Search ..... 272/61, 71, 109, 110, 272/112, 136, 76–78; 434/254; 114/230; 43/21.2

[56] References Cited

U.S. PATENT DOCUMENTS

| | | | |
|---|---|---|---|
| 2,434,543 | 1/1948 | Borroughs | 434/254 |
| 3,745,692 | 7/1973 | McGee | 43/21.2 |
| 3,880,422 | 4/1975 | Boggild et al. | 272/110 |
| 3,981,500 | 9/1976 | Ryan | 272/109 |
| 4,095,657 | 6/1978 | Hohwart | 272/71 |
| 4,248,419 | 2/1981 | Hohwart | 272/71 |

*Primary Examiner*—Richard J. Apley
*Assistant Examiner*—S. R. Crow
*Attorney, Agent, or Firm*—Eugene F. Malin

[57] ABSTRACT

An exercising device for use by a swimmer for simulating a free swimmer's planing force across the surface of a body of water. The device comprises a base including a plurality of holding conduits for securing a resilient member from which a line attaches to a user's harness. The resilient member is designed to provide an upward force that approximates the upward planing force of a swimmer.

4 Claims, 3 Drawing Figures

EXERCISING DEVICE

BACKGROUND OF THE INVENTION

This invention relates to an exercising device for providing a reaction force to confine a swimmer to one area and an upward force simulating a planing force approximating the planing force of a free swimmer exerting the same swimming force.

In the past, devices for in-place swimming supplied only reaction forces such as described in U.S. Pat. No. 4,109,905. British Pat. No. 330,482 shows a complicated mechanism that allows the swimmer to slide along on a rope. The concept disclosed in the present invention is not found in the prior art.

SUMMARY OF THE INVENTION

An exercising device is for use by a swimmer for simulating a free swimmer's planing force across the surface of a body of water in a small area of the body of water. The exercising device prevents the swimmer from reaching the other side of the body of water. The exercising device includes a base, resilient member having a distal end portion and a base end connected to the base, a connecting line connected to the distal end and a harness connected to one end of the line. The base is fixed at one end of the body of water. The base end of the resilient member is connected to the base to fix the base of the resilient member in one position. The distal end portion of the resilient member includes a connector that is connected to one end of the line, with the other end of the line connected to the swimmer's harness or belt. The harness or belt includes a strap with a around the strap.

The resilient member is designed to provide an upward force on a nearby stationary swimmer that approximates the upward planing force of a free swimmer moving over the surface and through the body of water. The rearward holding force keeps the swimmer in a confined area and keeps the swimmer from reaching the other end of the body of water. The distance that the swimmer is allowed to move away from the base is relative to the swimming force or pulling force of the swimmer's strokes at a particular time. The upward force exerted by the resilient member is relative to the distance the swimmer is positioned away from the base. The resilient means is designed to provide an approximate upward force that is generally equal to the planing force of a free swimmer exerting the particular swimming force or pulling force.

It is an object of the invention to allow a swimmer to exercise by continuously swimming in one direction in a small body of water without having to turn around.

It is another object of the invention to provide a resilient member that provides a holding force to prevent the swimmer from reaching the other side of the body of water and to provide an upward lifting force to simulate a swimmer's planing force.

In accordance with these and other objects which will be apparent hereinafter, the instant invention will now be described with particular reference to the accompanying drawings.

DESCRIPTION OF THE PREFERRED EMBODIMENT

Figure 1:
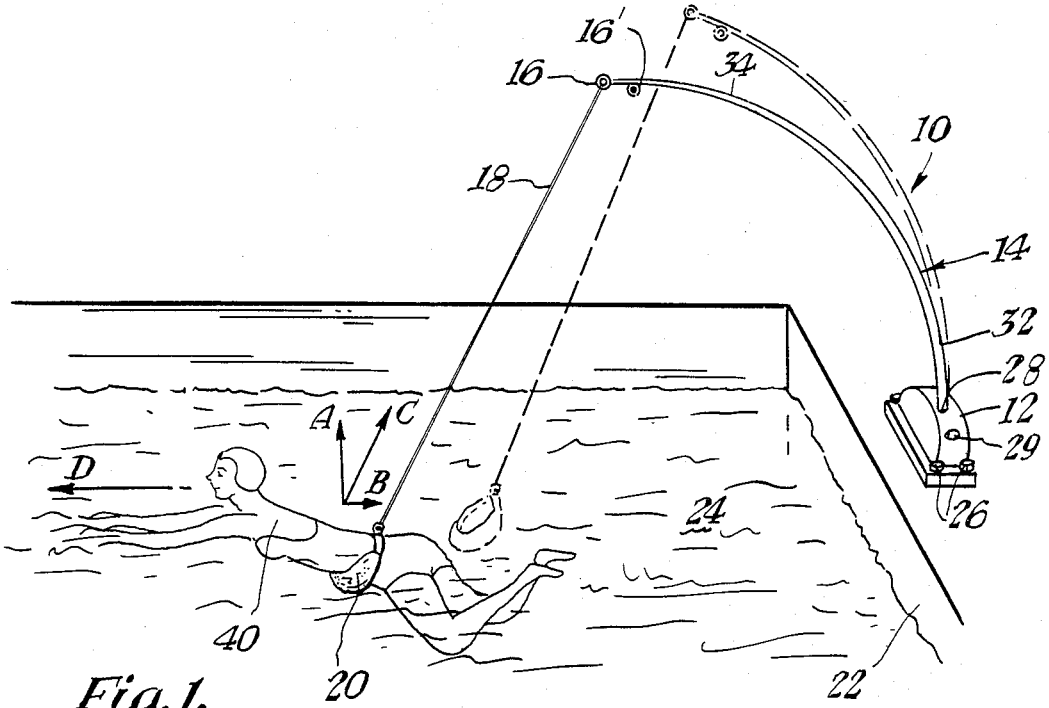
FIG. 1 is an illustration of a swimmer exercising with the exercising device.
Figure 2:
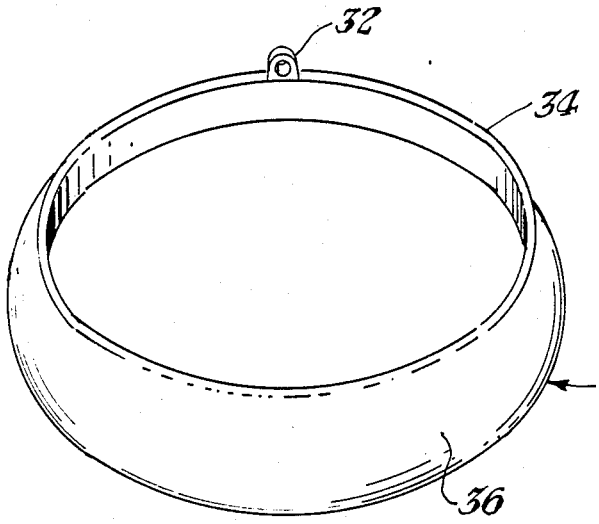
FIG. 2 is an enlargement of the belt.
Figure 3:
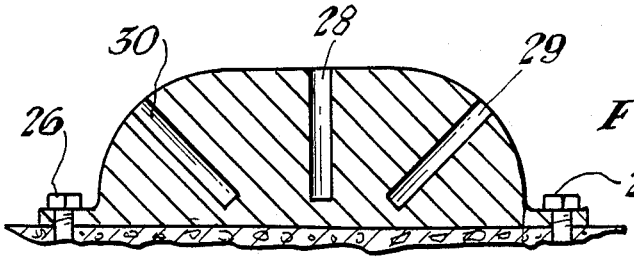
FIG. 3 is a cross-section of the base.

Referring now to the exercising device 10 illustrated in FIG. 1, the exercising device 10 includes a base 12, a resilient member 14, connector 16, line 18, and a belt or harness 20. The base 12 is anchored to one side 22 of the swimming pool 24 by bolts 26 as shown in FIGS. 1 and 3. The base 12 may include holding conduits 28, 29, and 30. The resilient member 14 has a base portion 32 and a distal portion 34. The base portion 32 of each resilient member is inserted into the conduit. A set screw, not shown, may be used to fix the base portion in each conduit 28, 29, and 30. The harness or belt 20 includes a connector 32, a strap portion 34, and a foam cover 36 for comfort. The strap portion 34 may include an adjustable bucket, not shown, or an expandable resilient portion, not shown.

The exercising device 18 may be used in a swimming pool system which allows short pools to be effectively used for simulated long swims without having to repeatedly turn at each end of the pool. The swimming pool system allows a swimmer to generally swim in a normal fashion in a short pool. The exercising device 10 supplies a simulated planing force, shown by Arrow A, exerted on the swimmer's body. The swimmer 40 is connected to the system for a continuous swim in one direction at one speed or at various speeds. The system includes an anchoring means 26 connecting the base to the pool. The tapered resilient pole 14 is connected to the base or anchoring device. One connection line 18 is connected to both the distal end portion 34 of the resilient pole 14 and the swimmer via the belt 20.

The resilient pole 14 of the new and improved system provides the reaction force, shown by Arrow B, to hold the swimmer back. The swimmer 40 is generally held back in one swimming area of the pool to prevent forward progress to the opposite side of the pool (not shown). The simulated planing force A is also provided by the resilient pole 14 to hold the swimmer up generally on the surface of the pool water as though the swimmer were free and the free swimmer was actually moving forward and planing over the water in the pool water. The upward force or planing force varies automatically in relation to the forward driving force of the swimmer, shown by Arrow D. The automatic varying forces are manufactured into the design of the resilient pole, a fiberglass pole.

The exercising device 10 is for use by a swimmer for simulating a free swimmer's planing force A across the surface of a body of water in a small area of the body of water. The exercising device 10 prevents the swimmer from reaching the other side of the body of water. The exercising device includes a base 12 of various shapes, resilient member 14 having a distal end portion and a base end connected to the base, a connecting line 18 (Force C) connected to the distal end, and a harness connected to one end of the line. The base 12 is fixed at one end of the body of water. The base end portion 32 of the resilient member is connected to the base to fix the base of the resilient member 14 in one position. The distal end portion 34 of the resilient member includes a connector or connectors 16 that are connected to one end of the line, with the other end of the line connected to the swimmer's harness or belt 20. The harness or belt 20 includes a strap 34 with a foam rubber material 36 around the strap.

The resilient member 14 is designed to provide a force C including an upward force A on the nearly stationary swimmer 40 that approximates the upward planing force of a free swimmer moving over the surface and through the body of water. The rearward holding force B keeps the body of the swimmer in a confined area and keeps the swimmer from reaching the other end of the body of water. The distance that the swimmer is allowed to move away from the base is relative to the swimming force or pulling force D of the swimmer's strokes at a particular time. The upward force exerted by the resilient member is relative to the distance the swimmer is positioned away from the base. The resilient means is designed to provide an approximate upward force that is generally equal to the planing force of a free swimmer exerting the particular swimming force or pulling force.

What is claimed is:

1. An exercising device for a swimmer to allow generally free movement of legs and arms while providing an upward force approximating the planing force of a free swimmer and providing a reaction force to hold the swimmer in one area of the body of water, comprising:

a base;

said base including a plurality of holding conduits, a variable force means comprising a flexible pole for providing a reaction force means and an upward force means, said variable force means connected to one of said holding conduits in said base;

connecting means connected to said variable force means and connectable to a swimmer;

said reaction means for providing a variable reaction force that allows movement of the swimmer in one area of the body of water away from said base in relationship to the swimming force of the swimmer; and said upward force means for providing an upward force to the swimmer for simulating a planing force of a free swimmer;

said upward force means increasing as said reaction force increases and as the swimmer's swimming force increases.

2. An exercising device as set forth in claim 1, wherein said connection means includes:

a line connected to said resilient member and a body connector for the swimmer connected to said line.

3. An exercising device as set forth in claim 2, wherein:

said resilient member is a fiberglass pole with a base portion and a distal portion, said pole having a tapering cross-section of reduced diameter toward the distal end of said pole.

4. An exercise device to provide an upward force approximately the plane force of a free swimmer and providing a reaction force with the swimmer held in an area of the body of water, comprising:

a base for anchoring to one side of a swimming pool;

said base including a plurality of conduits at different angles;

said base anchored to the side of a swimming pool by bolts;

a variable force means for providing a reaction means and an upward force means, said variable force means connected to one of said holding conduits in said base;

said force means includes a flexible fiberglass pole with a base portion for inserting selectively in one of said holding conduits and a distal portion, and connecting means connected to said variable force means and connectable to a swimmer;

said reaction means for providing a variable reaction force that allows movement of the swimmer in one area of the body of water away from said base in relationship to the swimming force of the swimmer; and said upward force means for providing an upward force to the swimmer for simulating a planing force of a free swimmer;

said upward force means increasing as said reaction force increases and as the swimmer's swimming force increases, said connecting means including a line connected to said fiberglass pole and a body connector for the swimmer connected to said line.

* * * * *

UNITED STATES PATENT AND TRADEMARK OFFICE

Certificate

Patent No. 4,530,497 Patented July 23, 1985

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is Donald E. Bellerive.

Signed and Sealed this 3rd Day of February, 1987.

BRADLEY R. GARRIS,
*Office of the Deputy Assistant Commissioner for Patents.*